US005534673A

United States Patent [19]

Lehmann et al.

[11] Patent Number: 5,534,673

[45] Date of Patent: Jul. 9, 1996

[54] ELECTRIC HIGH-VOLTAGE CIRCUIT BREAKER

[75] Inventors: Volker Lehmann; Heiner Marin, both of Berlin, Germany

[73] Assignee: Siemens Aktiengesellschaft, Munich, Germany

[21] Appl. No.: 253,636

[22] Filed: Jun. 3, 1994

[30] Foreign Application Priority Data

Jun. 4, 1993 [DE] Germany ..... 9308586 U

[51] Int. Cl.[6] ..... H01H 33/70; H01H 33/04

[52] U.S. Cl. ..... 218/68; 218/78; 218/84

[58] Field of Search ..... 218/43, 45, 48–50, 218/53–55, 57, 60, 65, 66–68, 72–74, 78, 80, 82, 84, 88, 145

[56] References Cited

U.S. PATENT DOCUMENTS 3,846,601 11/1974 Leeds ..... 218/74
3,943,314 3/1976 Frink ..... 218/60
4,041,263 8/1977 Noeske ..... 218/60
4,810,840 5/1989 Okuno ..... 218/145

*Primary Examiner*—J. R. Scott
*Attorney, Agent, or Firm*—Kenyon & Kenyon

[57] ABSTRACT

A high-voltage circuit breaker has a metallic housing. The contact member assembly is held by insulating supports, and has a fixed contact member and a movable contact member. The movable contact member is capable of being driven via an operating lever by means of a drive rod. The drive rod extends through one of the insulating supports. To seal the insulating support from hot quenching gases when the switch is actuated, an insulating disk sealingly surrounds the drive rod and is float-mounted on the insulating support. This allows for compensation of radial movements of the drive rod.

2 Claims, 1 Drawing Sheet

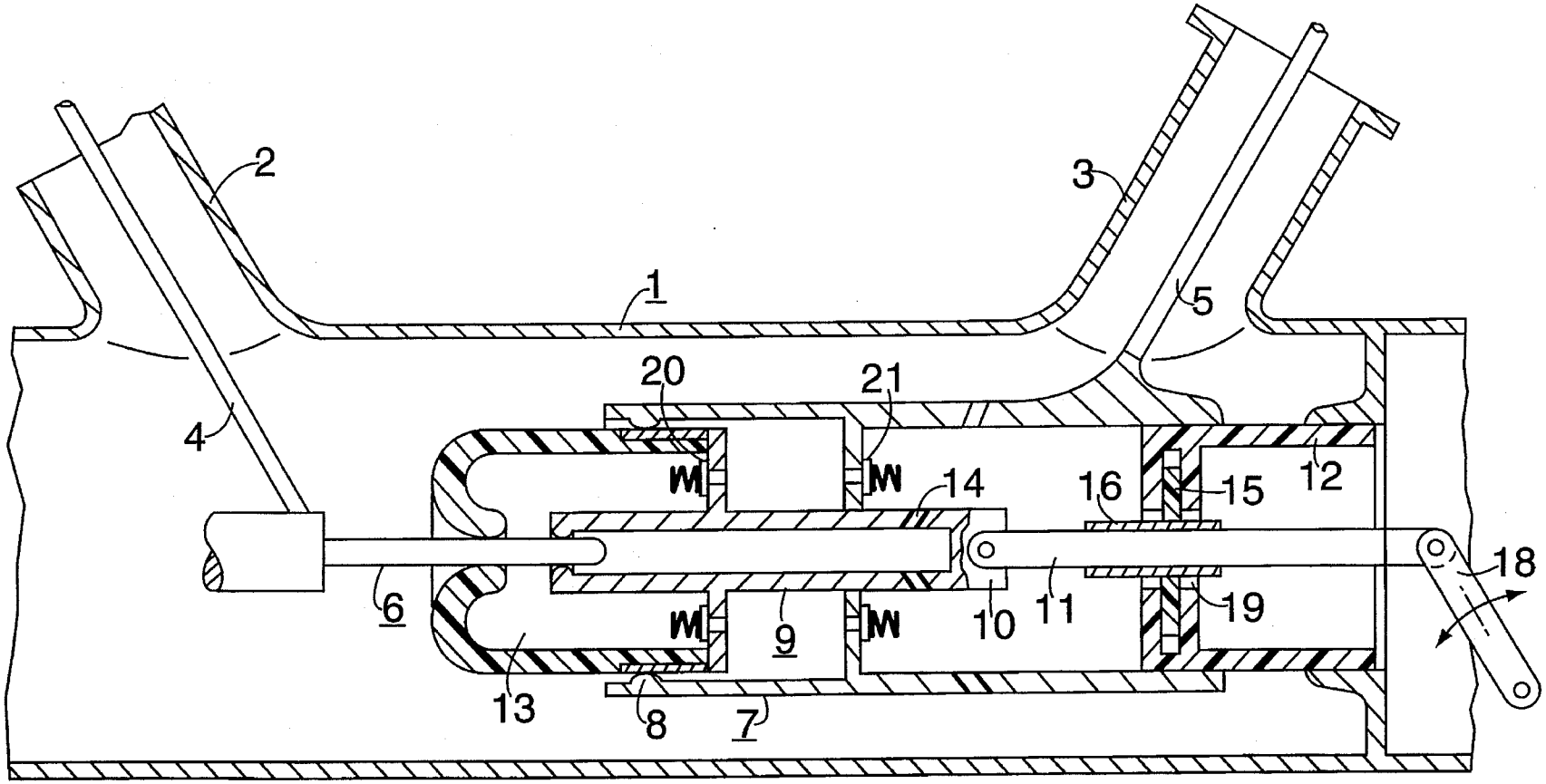
18
12
15
19
5
3
16
11
10
14
21
9
7
20
8
1
13
6
2
4

ELECTRIC HIGH-VOLTAGE CIRCUIT BREAKER

FIELD OF THE INVENTION

The invention relates to an electric high-voltage circuit breaker having an interrupter or contact member assembly, and more particularly to a circuit breaker which is secured with insulation in a metallic housing by means of an insulating support. The invention includes a movable contact that is capable of being driven via a swivel operating lever by means of a drive rod. The insulating support has a hollow design and an opening that is traversed by the drive rod.

BACKGROUND OF THE INVENTION

A circuit breaker is described, for example, by U.S. Pat. No. 4,810,840 which discloses, in FIG. 4, a switch with a movable contact that is driven by means of a drive rod. In this case, the contact has a cylindrical design and is guided through an opening in a metallic member. The member bears the quenching nozzle and the compression device. Under normal circumstances, it is very difficult to seal the opening from the hot quenching gases which occur during switching operations. Thus, hot quenching gases may penetrate into the space in which the drive rod moves. This creates the risk that the insulating support will be contaminated on its outside by quenching gases. When this occurs, electrically conductive films may settle on the insulating member which could adversely affect its insulating properties and thus lead to inadvertent discharging.

Therefore, it would be advantageous to provide a design that protects the drive rod and the insulating support from the effect of switching gases.

SUMMARY OF THE INVENTION

The present invention provides such an advantageous design. An insulating disk is provided which is float-mounted in the insulating support and sealingly surrounds the drive rod to seal off the opening.

As the drive rod is moved by means of a swivel operating lever, in addition to the intended axial movement, there may also be an undesired radial movement. This movement is compensated for in the present invention by the float-mounted insulating disk which slides sealingly on the drive rod. This ensures that the inside of the insulating support is well-protected from hot quenching gases. In addition, the section of the drive rod that is inside the insulating support is protected from the hot quenching gases.

One advantageous refinement of the invention provides for the insulating disk to be made of polytetrafluoroethylene. This material is especially heat-resistant and has especially low sliding friction.

A bushing can also be provided upon which the insulating disk glides. The bushing may be advantageously made of steel, it may be secured to the drive rod, and it may extend through the insulating disk. This also helps prevent the drive rod from being subjected to wear and tear caused by friction on the insulating disk. Furthermore, the coefficient of sliding friction may also be reduced, as the steel bushing can be machined to have a very smooth surface. Moreover, the section of the drive rod surrounded by the steel bushing is protected from the hot quenching gas.

BRIEF DESCRIPTION OF THE FIGURES

FIG. 1 schematically depicts one section of an embodiment of a circuit breaker of the present invention.

DETAILED DESCRIPTION

A circuit breaker of the present invention has a metallic housing 1 with first and second housing connecting sleeves 2 and 3. First and second housing connecting sleeves 2 and 3 surround first and second supply leads 4 and 5 of a switch, respectively. The first supply lead 4 is conductively connected to a stationary contact member 6. The second supply lead 5 is conductively connected via a contact member carrier 7 and a sliding contact 8 to a movable contact member 9.

The movable contact member 9 has a hollow design and is provided with segments that are designed to receive the stationary contact member 6. It also includes valve elements 20 and 21. At an end 10 of the movable contact member 9, situated opposite the receiving point of the stationary contact member 6, the movable contact member 9 is hinged to a drive rod 11. Drive rod 11 can be moved by means of a swivel operating lever 18. A mechanical driving mechanism (not shown), for example, a stored-energy spring mechanism or a hydraulic drive, acts on the operating lever 18.

The contact member carrier 7 is connected by way of an insulating support 12 to the metallic housing 1. The stationary contact member 6 is retained by a similar design in the metallic housing 1 of the switch (not shown).

When the stationary contact member 6 separates from the movable contact member 9, an electric arc is formed which heats and ionizes a quenching gas in a heating space 13. A portion of the quenching gas can escape through the movable contact member 9 and its relief openings 14 to the insulating support 12. As the insulating support 12 must reliably insulate the contact member carrier 7 from the metallic housing 1, care must be taken to ensure that the surface of the insulating support 12 does not contact the hot quenching gases, since otherwise a conductive layer could form on the surface of the insulating support 12. To guarantee that the inside of the hollow insulating support 12 is sealed off from the switching gases, a float-mounted insulating disk 15 is provided on the insulating support 12 and sealingly surrounds a steel bushing 16. The steel bushing 16, in turn, is securely and impermeably connected to the drive rod 11. The drive rod 11 is made of an insulating material, for example, a fiberglass-reinforced plastic.

The float-mounted insulating disk 15 guarantees that the opening 19 through which the drive rod 11 and steel bushing 16 pass is well sealed when the drive rod 11 moves radially, as sometimes occurs when the drive rod 11 is driven by the lever 18.

The insulating support 12 may be constructed, for example, of a fiberglass-reinforced plastic, and the float-mounted insulating disk 15 can advantageously be made of polytetrafluoroethylene.

As a result of this design, the drive rod and insulating support are protected from the effect of the quenching gases arising from the switching operation.

What is claimed is:

1. An electric high-voltage circuit breaker, comprising:

a housing;

an insulating support connected to said housing, said insulating support having an opening therethrough;

a drive rod passing through the opening in said insulating support;

a movable contact connected to one side of said drive rod;

an operating lever connected to a side of said drive rod opposite to that of said movable contact;

a stationary contact which is conductively connected to said movable contact when said movable contact physically engages said stationary contact;

an insulating disk in said insulating support, said insulat ing disk sealingly surrounding said drive rod and sealing the opening in said insulating support; and a bushing secured to said drive rod and extending through the opening in said insulated disk such that said insulating disk glides on said bushing.

2. The electric high-voltage circuit breaker of claim 1 wherein said insulating disk is made of polytetrafluoroethylene.

* * * * *